United States Patent [19]

Geiger et al.

[11] 4,154,194

[45] May 15, 1979

[54] APPARATUS FOR COATING A VISCOUS MEDIUM ONTO PREDETERMINED SURFACE PORTIONS OF WORKPIECE MEMBERS

[75] Inventors: Siegfried Geiger; Wilhelm Endlich, both of Munich, Fed. Rep. of Germany

[73] Assignee: Omni Technik, Mikroverkapselungsgesellschaft mbH, Munich, Fed. Rep. of Germany

[21] Appl. No.: 720,634

[22] Filed: Sep. 7, 1976

[30] Foreign Application Priority Data

Sep. 10, 1975 [DE] Fed. Rep. of Germany ..... 2540359
Sep. 26, 1975 [DE] Fed. Rep. of Germany ..... 2543117

[51] Int. Cl.[2] ..... B05C 3/04; B05C 3/09

[52] U.S. Cl. ..... 118/401; 118/612; 137/453

[58] Field of Search ..... 118/401, 232, 409, 612; 137/209, 453

[56] References Cited

U.S. PATENT DOCUMENTS

| | | | |
|---|---|---|---|
| 297,600 | 4/1884 | Hausheer | 118/232 X |
| 2,085,389 | 6/1937 | Durinton | 118/232 X |
| 2,682,253 | 6/1954 | Scherer et al. | 118/232 X |
| 2,685,303 | 8/1954 | Tolley | 137/453 X |
| 3,274,043 | 9/1966 | Schneider | 118/401 X |
| 3,334,643 | 8/1967 | Shamos | 137/209 X |
| 3,443,577 | 5/1969 | Nilsson | 137/209 |
| 3,795,224 | 3/1974 | Batson et al. | 118/409 X |
| 3,810,779 | 5/1974 | Pickett et al. | 118/401 X |
| 3,933,187 | 1/1976 | Marlinski | 118/401 X |
| 3,965,860 | 6/1976 | Cone et al. | 118/612 |
| 3,972,084 | 8/1976 | Reynolds | 118/409 X |
| 3,991,704 | 11/1976 | Hulstein et al. | 118/401 X |

*Primary Examiner*—Wm. Carter Reynolds

[57] ABSTRACT

An apparatus is provided for coating workpiece members fed one at a time to a coating station whereat individual workpiece members are coated with a viscous coating medium supplied from a reservoir under constant hydrostatic pressure to ensure coating of said workpiece members with a predetermined amount of the viscous medium of such viscosity as to be suspended, without dropping, from the opening of tubes depending from a coating applicator at the coating station supplied with viscous medium from the reservoir at constant hydrostatic pressure. The workpiece members thus coated are moved along a track, preferably rolling about their axes, dried and collected.

17 Claims, 5 Drawing Figures

APPARATUS FOR COATING A VISCOUS MEDIUM ONTO PREDETERMINED SURFACE PORTIONS OF WORKPIECE MEMBERS

BACKGROUND OF THE INVENTION

The invention relates to an apparatus for coating a viscous medium onto predetermined surface portions of a plurality of members each having an axis about which the members are symmetrical. Exemplary of such members are cylindrically shaped workpieces as, for example, screws, bolts and the like, the predetermined surface portions of which to be coated in the described embodiment, are threaded shank portions.

In the disclosure to follow, it is to be understood that when referring to cylindrically shaped workpieces, it is intended to encompass workpieces which may have essentially cylindrical bodies with either smooth or profiled peripheral surfaces, such, for example as peripheral threaded or knurled surfaces while at the same time having non-cylindrical portions such as the screw head portions of threaded members.

For securing threaded members, such as screws or nuts, against loosening, particularly under changing temperature, load, shock or vibratory conditions, it is known to use locking means such as lock washers, taper pins and even a coating material on the threaded portion of a screw, the coating material being a single or multi-component adhesive or hardenable liquid plastic which may be in micro-capsulated form. The present invention is concerned with (a) the use of a coating material on for example the thread portion of a screw member for ensuring secure, non-loosening threaded engagement with a complementary threaded member and (b) an apparatus for applying optimum, accurately determined, predetermined amounts of the coating material to the member to be coated.

Micro-encapsulation is accomplished by a physico-chemical process and involves encapsulation of miniscule amounts of fluids or solids as by coacervation. When the capsule is crushed, for example, by exertion of a predetermined pressure on the capsule, the encapsulated contents is released from the capsule. The size of the capsule, in the embodiment described, is a function of the pitch of the thread, taking into account design tolerances.

The microcapsules may be placed in a lacquerlike binder to provide a preparation having a viscosity of between 2000 and 5000 cp. Preferably, the microcapsules are uniformly distributed in the binder under action of agitator blades. A preparation suitable for coating cylindrical workpieces, comprising microcapsules in a liquid binder, is described in German publication 2,307,252.

Workpiece objects have been coated by different methods. For instance, externally dry microcapsules have been applied to objects provided with an adhesive or binder, microcapsulation application having been accomplished by dusting, dripping or other suitable means. Such methods, however, are inefficient since large quantities of coated screws cannot be produced using such coating techniques.

It has also been proposed to pass objects to be coated through an immersion bath containing a binder system and a lacquerlike liquid. This method, however, suffers from the inability to control coating thickness, area of application or operating speed.

Also known is a method suited for automated coating of objects, such method being described in German publication 2,307,238. The method described in this patent requires manifold stations in addition to a coating station to insure uniform coating application, especially due to release of the coating material through a zig-zag slot which is apt to release more coating material than required and to clog when operation is interrupted for a time during which the relatively viscous binder tends to solidify.

Moreover, with the method of this publication, because the viscous medium is squeezed out of the zig-zag slot under action of a pulsating pump, it is not possible to produce on the screw shank a coating of predetermined thickness. Furthermore, to vary the width of the coating to be applied, the coating device of this publication must be replaced because the width of the applied coating is a function of the width of the working area of the coating applicator. Hence, if the coating width is to be varied, the applicator head must be separated from the pump and exchanged.

SUMMARY OF THE INVENTION

Generally, the invention provides an apparatus which includes a viscous medium applicator having depending tubes formed with an open mouth at the terminus of the tubes, a track for the workpiece members being disposed under said viscous medium applicator with the axis of the workpiece members predeterminedly oriented on said track for engagement by means for moving the workpiece members along the track thereby enabling a viscous medium to be applied to predetermined surface portions of the workpiece members as they are moved on the track for eventual discharge.

More specifically, we provide in accordance with the invention apparatus for coating a viscous medium onto predetermined surface portions of a plurality of workpiece members each having an axis about which the members are symmetrical, comprising means including a track on which the plurality of members are supported for movement therealong with their axes in horizontal orientation perpendicular to their direction of travel along the track, a viscous medium applicator, containing a viscous medium, being disposed above said track and having a plurality of discharge tubes extending vertically downwardly toward the track over the members to be coated, the discharge tubes terminating in openings from each of which is suspended a predetermined quantity of the viscous medium. The track is spaced from the tube openings a distance governed by the cross sectional dimensions of the members at the predetermined surface portions to be coated to insure contact of the members with the viscous medium as the members are moved along the track past the discharge tubes, and means for thus moving the plurality of members along the track portion.

Since the viscous medium discharge is from the small tubes at their open lower ends instead of from an external working area as in publication 2,307,238, clogging is avoided. Also contamination of the applicator head is avoided because as will be seen from the disclosure to follow, the workpiece members do not contact the tubes, they only contact the viscous medium at the lower ends of the small tubes from which the medium is wiped by the passing members. Advantageously, the coating process time can be varied by determining the speed at which the workpiece members are moved past the underside of the viscous material applicator. The supply of viscous medium through the small tubes can readily be adapted to the speed of workpiece movement. The coating output may be regulated to satisfactorily coat from 1000 to 16000 workpieces per hour, depending on the workpiece dimensions.

The apparatus of the invention includes relatively few moving parts and, hence, reduces wear and error. Coating accuracy is enhanced because of the manner in which the tubes extend from the viscous medium applicator and because of the manner of feeding the workpiece members past the tubes which are arranged in arrays along the direction of movement of the members on the track and in arrays in a direction along which the axis of the workpiece members extend.

The apparatus of the invention may be used with different workpieces and not necessarily with screw members only. For example, dowels without a head formation may be coated by providing guide rails on either side of the track to prevent headless members from riding off the track.

By "viscous medium" as used herein is meant to include all viscous substances, coating mixtures, dispersions and preparations in liquid or paste form, in particular micro-encapsulated single or multicomponent adhesives or micro-encapsulated liquid plastics where the microcapsules are in a lacquerlike binder system having the approximate consistency of a loose liquid paste.

Where the viscous medium is used for coating threaded shanks or screws its consistency is preferably such that it can readily be wiped from the tube openings by the peripheral surface of the workpiece members as they move past the applicator tubes. The coating material thus wiped onto the peripheral surface of the workpiece members is uniformly spread thereover in consequence of cyclic variations in the speed of movement of such members along a track as will be described in greater detail hereinafter.

In the direction parallel to the axes of the workpieces, the tubes may be provided in an array having an extent corresponding to the axial extent of the workpiece area to be coated. This makes it possible to adapt the viscous medium applicator to the axial extent of the workpieces to be coated. This arrangement has the advantage of flexibility since if an applicator has an array of tubes which extend beyond the length of the surface to be coated only those tubes need be filled to discharge a coating medium which overlies the surface area to be coated. It will be obvious that by extension, the coating medium may be suspended from predetermined tubes only so that for example only the opposite ends of a headless screw are coated.

As previously noted, the tubes may also be arranged in an array in a direction of movement of the workpieces on the track so as to correspond to the developed length of the workpiece diameter, or to a multiple thereof. This ensures that an adequate amount of viscous medium is wiped from the tube openings and transferred to the workpiece members.

To improve the uniform spreading of the coating material over the workpiece, the tubes may be arranged in a zig-zag pattern as viewed in the direction of travel of the workpiece members. This makes it possible to increase the number of tube endings from which the viscous medium is applied to the workpiece surfaces.

Preferably, a vibratory motion, in a plane parallel to the track, is imparted to the applicator to facilitate the transfer of the viscous medium suspensions from the tube ends to the periphery of the workpiece. When using such vibratory motion, the outer surface of the workpiece need not be brought as close to the tube mouths, as when such motion is not used, because viscous medium transfer takes place with a relatively light contact of the workpiece surface with the viscous suspension.

For versatility of operation, the applicator is arranged to be movable to permit adjustment of the spacing of the tube ends from the upper workpiece surface to accommodate workpieces of different diameters. The applicator head is also mounted for movement transverse to the direction of travel of workpieces to permit adjustment of the position of the tubes depending from the applicator over the workpiece surfaces to be coated. Moreover, applicator exchange is also envisioned with the apparatus of the invention to accommodate workpiece diameters or coating extents which cannot be handled by adjustment of the viscous medium applicator.

The track on which the workpieces are moved comprises spaced rails in addition to which at least one guide rail may be provided, spaced from one of the two rails so that the head of, for example, a screw may be confined between the guide rail and the rail adjacent thereto. This ensures accurate alignment of the axis of the screw at right angles to the general direction of screw travel and thus also the position of the area to be coated. The distance between the two rails or to the guide rails is adjustable in stepless continuous manner according to the workpiece length, the head thickness, or even as a function of the center of gravity of the workpiece. This enables the apparatus, as aforementioned, to be employed for screws with a head as well as with headless screws, in which case a further guide rail is used adjacent the other of the pair of rails. Preferably, the height of the roller track, and thus its spacing from the ends of the tubes of the applicator, can also be varied in stepless continuous fashion.

The track has an inclined portion on which the cylindrical workpieces roll under the influence of gravity. Adjacent the bottom portion of the inclined track there is preferably provided a mechanism which permits only single workpieces at a time to continue on so that they pass below the applicator over a horizontal track portion as separate units for wiping off the viscous medium suspended from the applicator tube ends. The release of the workpieces by the mechanism is synchronized so that new droplets are formed on the applicator from the time that one workpiece passes under the applicator head to the time the next workpiece reaches the applicator head. The workpieces thus coated may be dried by feeding them into a drying tank.

When the workpieces reach the end of the inclined plane, they are preferably gripped by an endless conveyor belt which engages the workpieces on the horizontal track portion at regions not to be coated with the viscous medium so as not to interfere with the coating process. The belt, in particular its lower run engages the workpieces and causes the workpieces to roll along the track. The conveyor belt engaging the peripheral surface of the workpieces is of round cross section in the embodiment to be described so that the area of contact with the workpieces is small.

The conveyor belt is supported by several rollers so spaced apart that relatively low belt tension is assured. As a result, the lower run of the conveyor belt sags between adjacent rollers. The travel speed of the workpieces is reduced in the regions of belt sag because frictional forces between the conveyor belt and the workpieces is minimized. However, in the regions where the workpieces pass beneath the rollers frictional forces are increased so that the workpieces are better gripped whereby to increase the speed of travel of the workpieces in the region of these rollers. Accordingly, the workpieces may be moved at speeds which increase and decrease periodically depending for example on whether the workpiece is under a roller or between two adjacent rollers, this cyclic speed variation being instrumental in ensuring an even distribution of the coating medium applied to the workpiece.

The hydrostatic pressure of the viscous medium fed to the applicator must be constant if a predetermined amount of viscous medium is to be suspended from the tubes. This is accomplished by providing a reservoir, connected to the applicator, adapted to maintain a predetermined pressure head in the reservoir equal to the desired hydrostatic pressure at the tube ends, regardless of variation of liquid level in the reservoir. To this end, the interior of the reservoir is hermetically sealed above the viscous medium, whereas an outlet communicating with the applicator is provided at the bottom portion of the reservoir, an annular separate chamber being provided in the reservoir communicating with the atmosphere and in communication with the viscous medium in the reservoir through a bottom opening in the annular chamber.

With this arrangement, the hydrostatic pressure at the tube ends depends solely upon the difference in the level of the tube ends and the bottom edge defined by the bottom opening of the annular chamber. The hydrostatic pressure in the plane of the tube ends may be varied by moving the bottom edge of the annular chamber up or down or by moving the reservoir chamber relative thereto.

Coupled to the outlet is a three-way valve having OUT - IN - CLEAN positions. In the CLEAN position, a line to the applicator and the latter itself may be cleaned by suitable solvents before turning the valve to IN position. The reservoir may contain an agitator, driven by a controlled motor, the shaft and the agitator blades being removable from the reservoir. Since microcapsules, suspended in a carrier fluid and enclosing a coating substance are usually used as viscous medium, the microcapsules can be distributed uniformly by the agitator blades.

BRIEF DESCRIPTION OF THE DRAWINGS

The invention will now be described in relation to illustrative embodiments shown in the accompanying drawings, in which.

DESCRIPTION OF PREFERRED EMBODIMENTS

Figure 1:
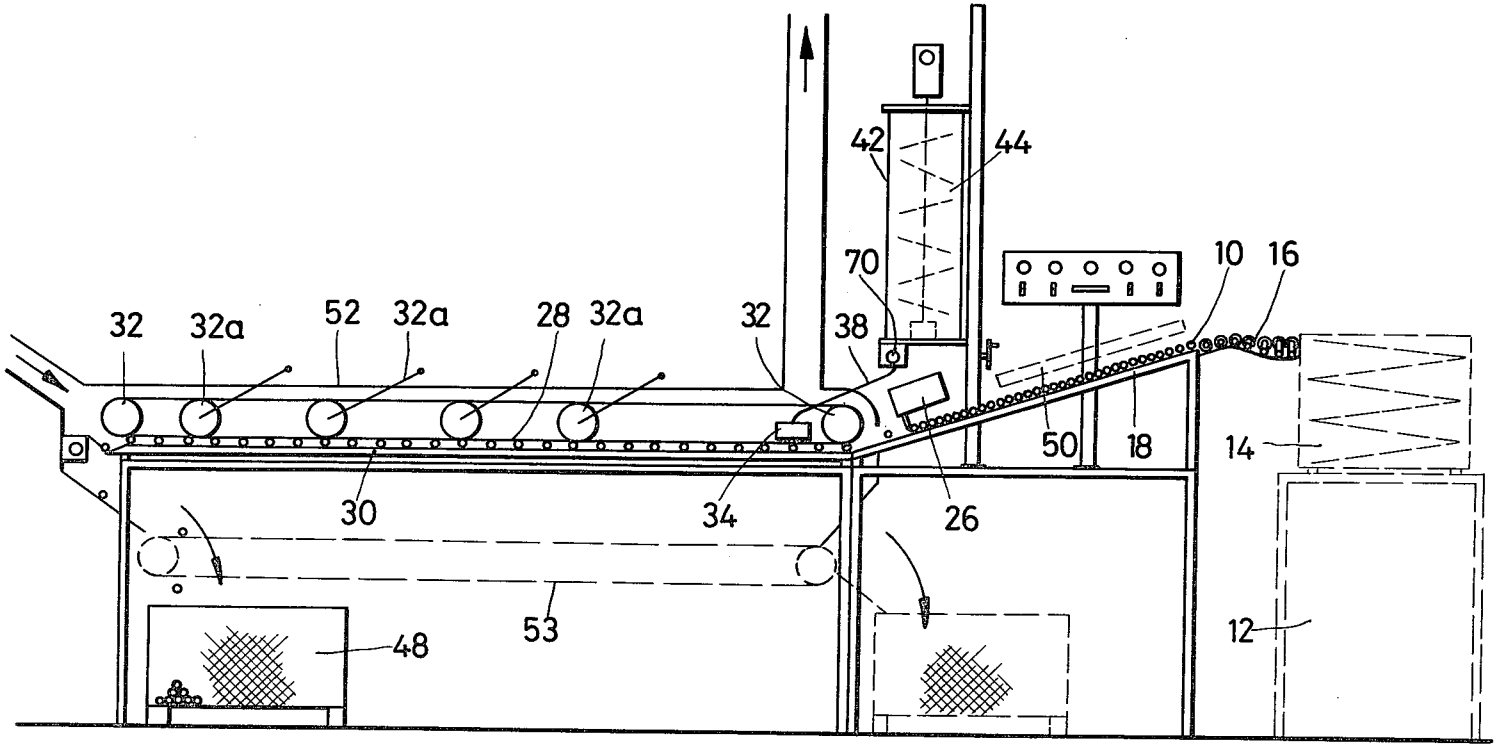
FIG. 1 is an overall side elevation view of the apparatus of the invention.

The components of the apparatus according to the invention will be described first, with FIG. 1, from right to left, as viewed in this Figure. For purpose of disclosure the workpiece members will be referred to as screws.

The screws 10 to be coated are stored in a feeder tank 12, from which they are removed by a device 14, such as a parts sorter or a shaker, and supplied to a screw manipulator 16 in which screws having heads can be brought from an upright hanging to a horizontal position. For headless screws these are supplied to the manipulator in axial alignment one behind the other and turned, in known manner, 90° into rolling position.

Figure 4:
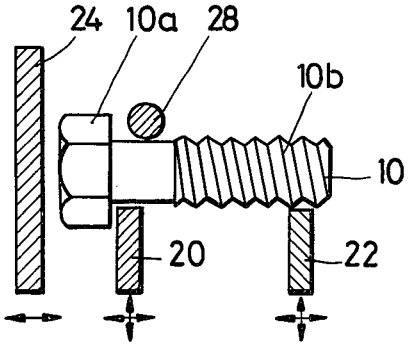
FIG. 4 is a section of a track with a screw thereon.
Figure 5:
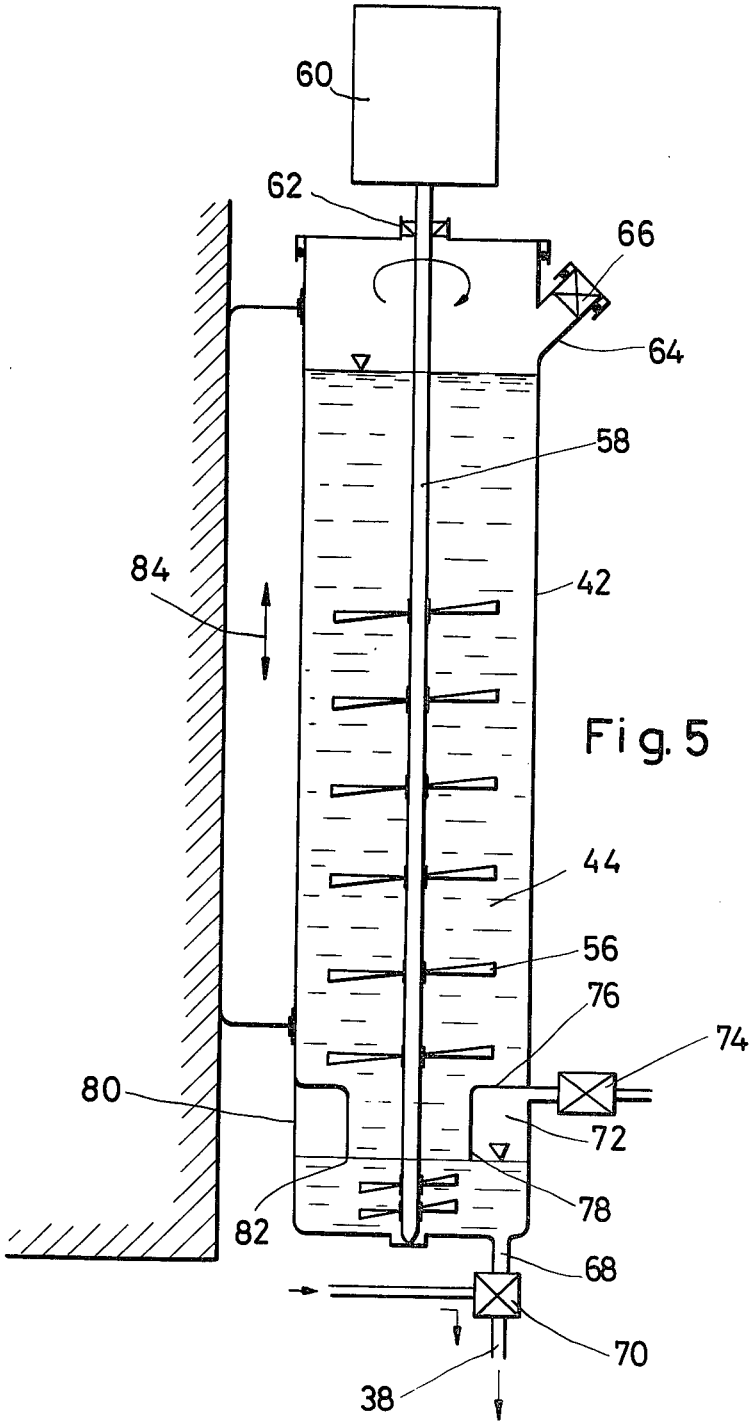
FIG. 5 is a section of a reservoir embodied in in the apparatus of the invention.

The manipulator 16 places the screws 10 on a track 18 which, as shown in FIG. 4, comprises two rails 20 and 22 on which the cylindrical part of the screws rests. At least one of the rails is movable relative to the other a distance sufficient to permit the rails to be straddled by the predetermined workpiece; relative spacing of the two rails being adjustable steplessly, by a spindle drive (not shown). Adjustment is intended to take into account different threaded screw shank lengths and may also be used to change the screw center of gravity. For lateral spacing, there is provided adjacent rail 20 (as seen in FIG. 4) a guide rail 24 whose spacing from rail 20 is adjustable (by means not shown) so that a head **10*a* of screw 10 may be disposed in the space with slight clearance between rails 20 and 24. The shanks 10*b* of screws 10 are supported on the two rails 20 and 22. Conversely, the rail 20 alone may be made adjustable relative to guide rail 24** for suitable positioning of the head of the screw therebetween.

For coating of headless screws, it is advantageous to dispose to the right of rail 22, as viewed in FIG. 4, another guide rail (not shown) to restrict axial movement of the screw and to maintain the screw in predetermined orientation during its movement along the track.

The rolling screws, thus guided, run down the inclined track 18 towards a preferably, electrically operated mechanism 26 which functions to hold the advancing screws in a waiting position for successive release under control of an infinitely variable timing circuit for movement to a coating station. During the time that a screw is held in holding position by mechanism 26 a previously released screw is fed to a coating station for application thereto of the viscous medium. The screw is held by mechanism 26 until a predetermined amount of the viscous medium has collected at the coating station, as will become clear from the disclosure to follow. In this manner, it is possible to regulate the amount of viscous material which will be available at the coating station when the screw is released by mechanism 26. Thus, the larger the diameter of the screws to be coated, the longer will be the holding time of the screws by mechanism 26 to permit, during the increased time delay, formation of larger quantities of viscous medium for application to a held screw when released by mechanism 26.

The individual screws 10 released by mechanism 26 roll down the bottom end of the inclined track 18 for gripping engagement by a conveyor belt 28 which rolls the screws 10 over a horizontal track extension 30 of inclined track 18. Track 30 is thus also comprised of tracks 20 and 22 and preferably includes guide rails on the lateral outer sides of rails 20, 22.

Accordingly, the shanks **10*b* of the screws 10 rest on the rails 20, 22 while the heads 10*a* of the screws 10 are guided between a guide rail and rail 20 as they are moved by belt 28 along the track 30**.

Endless belt 28, of circular section i.e. having an upper and lower run (see FIG. 4), engages at its lower run a surface of shank 10*b* of screw 10 in a region which does not interfere with the application of a viscous medium to the threaded shank 10*b*.

Figure 3:
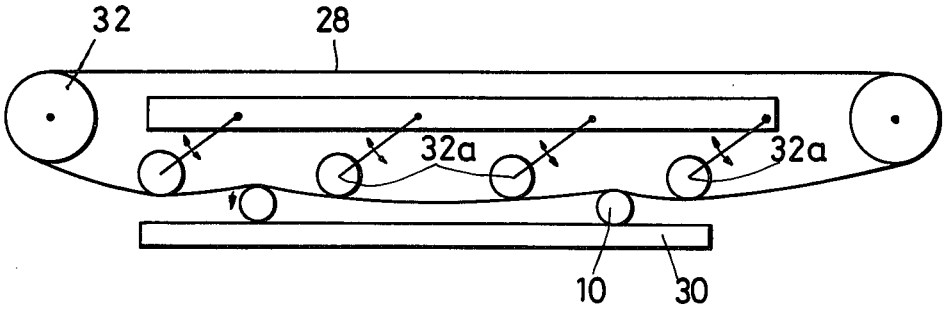
FIG. 3 is a side view of the conveyor belt with the screws.

The conveyor belt 28 is driven by one or more drive rollers 32 and runs across spring-mounted supporting rollers 32*a* disposed in spaced apart relation between rollers 32. Relatively little tension is exerted by rollers 32 on the conveyor belt 28 so that the conveyor belt 28 sags (as seen in FIG. 3) between the supporting rollers 32*a*. Accordingly, there is considerable slippage in the zones between the supporting rollers 32*a* so that the screws 10 in such zones are transported along track 30 at a relatively slow rate whereas in the region of belt contact with rollers 32*a* because of significantly increased frictional forces between the conveyor belt 28 and the threaded shanks 10*b*, the screws are transported along track 30 at significantly greater speeds than in the slippage zones of the belt. The speed of the screws 10 on track 30 therefore cyclically increases and decreases. By adjusting the speed of the conveyor belt 28 it is possible to adjust the distance between the individual screws, supplied by mechanism 26, as they are moved along track 30. The spacing between the conveyor belt 28 and the track adjusts automatically to screws of different diameter by virtue of the resilient mounting of rollers 32*a* as shown in FIG. 3.

During their rolling motion on track 30, the individual screws 10 are transported by conveyor belt 28 under a coating station at which an applicator 34 is provided. The applicator has downwardly depending small tubes 36 whose lower ends are open. As may be seen from FIG. 2, four tubes 36 are disposed along the direction of travel of screws 10, it being understood that as many tubes are disposed in transverse direction; e.g. a total of 16 tubes in the illustrated embodiment. The applicator is connected to a reservoir 42 containing a viscous coating medium 44 through a supply line and switching valve 70.

The coating medium 44 flows from the reservoir 42 into the interior of the applicator 34 in which a uniform hydrostatic pressure is maintained to in turn ensure maintenance of a uniform hydrostatic pressure in the application plane 46 (see FIG. 2) at the mouths of the tubes 36. The quantity of coating medium suspended from the mouths of the tubes 26 over a given time depends on the hydrostatic pressure. By maintaining the pressure constant, suspension of a constant amount of viscous medium is ensured.

Figure 2:
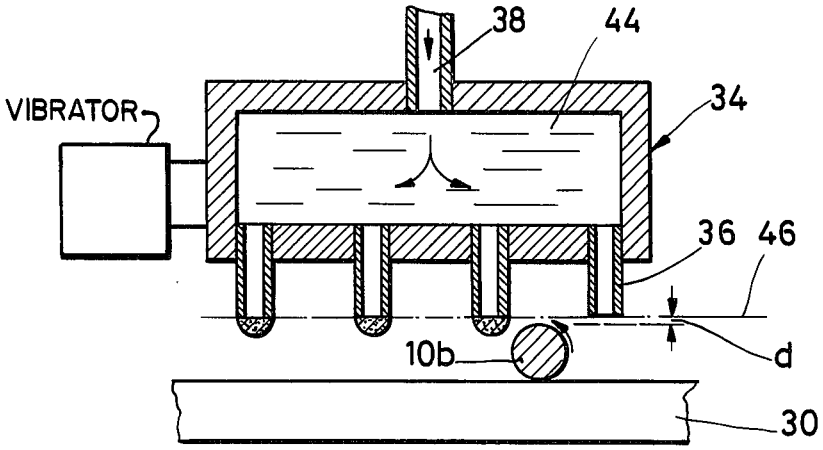
FIG. 2 is a sectional view of an applicator with a screw to be coated.

As will be seen in FIG. 2, the distance d between the track, i.e. the upper edge of the rails 20 and 22 and the lower end of the tubes 36 is slightly larger than the diameter of the threaded shank. The applicator 34 is preferably made height-adjustable for adjustment of this distance. With the spacing of track 30 from tubes 36 as just described, screws 10 rolled by the conveyor belt 28 down the track 30, on passing under the lower ends of tubes 36, will wipe off the coating medium droplets suspended from the lower tube ends 36 as illustrated in FIG. 2. As the threaded shanks 10*b* are transported along the track 30 by belt 28, the coating medium 44, applied in one or more places on the screw shanks, will spread evenly over the entire threaded shank area to be coated, because of the aforementioned cyclic change in the speed of the rolling screw motion. The axial extent of the coating on the threaded shank 10*b* is determined by the extent of the array of tubes in that direction, the extent of the array of tubes in a transverse direction being determined by the diameter of the threaded shank. In other words, the array of tubes in the transverse direction has such an extent as to correspond to the developed lengths of the surface portions of the workpieces. Preferably, the applicator 34 is bodily adjustable to permit coating of selected areas of screws as the latter roll pass the applicator.

The thus coated screws 10 are rolled for a predetermined distance along the track 30 by the conveyor belt 28 for discharge into and collection in container 48.

Depending on the type of coating medium used, it may be expedient to preheat the screws prior to the coating operation so that drying of the coated screws 10 can be accelerated. In that case, track 18 may include a preheating section, for example, an infrared radiator 50, disposed in relation to track 18 as shown in FIG. 1, to bring the screws 10 to a temperature of about 50° to 60° C.

If a solvent-steam degreasing line is used for degreasing of the screws before coating thereof, the infrared radiator 50 may be dispensed with because the screws will leave the degreasing line in relatively hot state. Therefore the inherent heat of the screws can be utilized in such a case, to dry the coating medium. Where, however, the inherent heat of the screws 10 is insufficient for thorough drying of the coating material, a drying tunnel 52 may be provided in which case a further conveyor belt 53 is used for discharging coated screws, in dried state, into container 48'. If the coating medium contains highly volatile, flammable solvents, the applicator 34 and the drying tunnel 52, in particular, must be appropriately ventilated.

As previously mentioned, the hydrostatic pressure at the lower ends of the tubes 36 must be constant in the application plane 46 so that the same amount of coating medium will be suspended from the tubes, per unit time, and remain suspended, without dropping from the tube mouths. Normally, the hydrostatic pressure varies with level variation of the coating medium in the reservoir 42. For this reason, it has been the practice to use an infinitely variable pump of constant output to compensate for hydrostatic pressure variations resulting from coating medium level variations in the reservoir. Such pumps, however, have limited utility in that they have little effect if the viscous coating medium 44 starts solidifying, as would occur, if pump operation is interrupted for but a short period of time. In the apparatus according to the invention, we provide a reservoir which operates independently of an infinitely variable pump to maintain constant the hydrostatic pressure at the coating medium plane 46. The reservoir 42 of the invention contains an agitator with agitating blades 56 and an agitator shaft 58 driven by a variable speed motor 60. The agitator can be withdrawn from the reservoir 42 if desired for cleaning. The agitator shaft 58 is mounted in the upper cover of the reservoir 42 with an airtight seal 62. At the upper end of the reservoir 42 is a filling spout 64 through which the coating medium is supplied, which spout is hermetically sealed by cover 66.

At the bottom of the reservoir 42 is provided an outlet opening 68 which may be shut by a three-way valve 70 and which communicates with the applicator 34 via the supply line 38. The supply line 38 and the applicator can be rinsed through the valve 70 when required by shutting off line 68 from line 38 and by opening line 38' to line 38.

Provided in the proximity of the lower end of and inside the reservoir 42 is an annular chamber 72 which is open at its bottom and communicates with the atmosphere through a shut-off valve 74. The annular chamber has an upper wall 76 extending radially relative to the reservoir 42 and an inner wall 78 extending axially, the outer wall 80 of the annular chamber being formed by the wall of the reservoir 42. The underside of the annular chamber is open towards the coating medium.

To fill the reservoir with viscous medium, the shut-off valve 74 and 70 are initially closed so that the coating medium, with cover 66 removed, is fed through the filling spout 64 to a predetermined fill level in the reservoir 42. A safety lock may be provided to ensure that the filling opening in the spout is accessible only when the shut-off valve 70 and 74 are closed.

The reservoir is in effect an inverted bottle having an opening at its lower end only which is inserted in a pan of liquid and which opening is maintained at the level 82. Thus, when valves 70 and 74 are opened, air is allowed to travel through the liquid in the reservoir causing the liquid to fall into the lower portion of the reservoir below the level 82, until such time as the level 82 reaches the opening of the bottle forming the reservoir. This effect is obtained regardless of the pressure of the air in the annular space around the neck of the reservoir. This balance, that is the level of the liquid at the level 82, will be maintained by the intermittent movement of liquid from the valve 70 by the intermittent falling of the liquid from the reservoir.

In operation, with the valves 70 and 74 closed the shaft 58, driven by the motor 60, rotates so that the viscous coating medium 44, consisting of a dispersion, is agitated and thus constantly mixed. The shut-off valves 70 and 74 are then opened to allow viscous coating medium to flow out of the outlet opening 68 through the supply line 38 into the applicator 34, the hydrostatic pressure in the application plane 46 being determined by the level difference between the application plane 46 and the lower edge 82 of the annular chamber, and thus is independent of the filling level of the coating medium in the reservoir. This is the case because of the head of atmospheric pressure applied through valve 74 to the coating medium in the plane of the surface defined by the bottom opening of chamber 72. It should be understood that substantially the entire extent of reservoir 42 is filled with the coating medium except for a relatively small, closed, upper air chamber. The annular chamber 72 on start-up contains compressed air or coating medium. Upon opening the shut-off valves 70 and 74, entry of fluid medium into the annular chamber is determined and with the filler valve 66 closed, the pressure of the liquid column between the lower edge 82 of the annular chamber 72 and the filling level of the coating medium 44 is compensated by atmospheric air pressure so that the liquid can drain from the main reservoir chamber at a hydrostatic pressure determined by the level of the second liquid column at edge 82 of the annular chamber 72. Because hydrostatic pressure changes will occur only when the coating medium level falls below lower edge 82, it will be apparent that draining of coating medium from the reservoir can be tolerated for long periods of time without changing the hydrostatic pressure at application plane 46.

To change the hydrostatic pressure in the application plane 46, it is possible to either raise the entire reservoir, (as shown by arrow 84), or to move the annular chamber up or down, when it is desired to do so, relative to the reservoir elongate chamber. If adjusted to a new position, the hydrostatic pressure at the mouths of the tubes 36 will again depend on the level difference between the lower edge 82 of the annular chamber and the application plane.

A control panel 86 may be provided for centrally controlling operation of various components of the apparatus; e.g. the reservoir 42, the applicator 34, the conveyor belt 28, and the feed device 14.

What is claimed is:

1. Apparatus for coating a fluid viscous medium onto predetermined surface portions of a plurality of workpiece members each having an axis about which said members are symmetrical, comprising a track for supporting said members with their axes in horizontal orientation perpendicular to their direction of travel along said track, a viscous medium applicator disposed above said track, said applicator comprising a plurality of discharge tubes extending vertically downwardly toward said track each terminating in an end having an opening, means for supplying viscous medium to said applicator at a constant pressure to permit the suspension at the end of each of said tubes of a droplet of said viscous medium, comprising a reservoir for the viscous medium, an outlet line extending from the reservoir and connected to the viscous medium applicator, a valve in said outlet line, said reservoir having a hermetically sealable filling spout at an upper end portion thereof and a separate annular chamber therein at a bottom end portion thereof adapted to communicate with the atmosphere and with the interior of said reservoir through a bottom opening formed in said separate chamber, said discharge tubes being spaced from said track a distance governed by the cross sectional dimension of said workpiece members sufficient to ensure contact of said workpiece members with said suspended droplets of viscous medium as said members are moved along said track so as to wipe said suspended viscous medium therefrom onto predetermined surface portions, and means for inducing movement of a succession of workpiece members along said track in alignment with said discharge tubes and longitudinally spaced from each other, the spacing being sufficient to permit a predetermined quantity of viscous medium to form droplets suspended from said discharge tubes prior to contact with the next succeeding one of said workpiece members.

2. Apparatus according to claim 1, wherein said tubes are provided in arrays extending along the direction of travel of said members on said track, said arrays extending a length corresponding to the developed length of the peripheries of the said predetermined surface portions of said members.

3. Apparatus according to claim 2, wherein said tubes are also provided in arrays extending along the axes of said members, with an extent corresponding to the axial extent of the said predetermined surface portions of the members to be coated.

4. Apparatus according to claim 1, wherein said discharge tubes, as viewed in the direction of travel of the members on the track, form a zig-zag pattern.

5. Apparatus according to claim 1, wherein means is provided for imparting vibratory movement to the said applicator.

6. Apparatus according to claim 1, wherein said track comprises spaced apart rails, at least one of said rails being movable laterally relative to the other a distance sufficient to permit the rails to be straddled by said predetermined surface portions of the members to be coated, said viscous medium applicator being spacially adjustable relative to said rails.

7. Apparatus according to claim 1, wherein the said track has two mutually spaced rails.

8. Apparatus according to claim 1, including an inclined track section down which said members are movable under the influence of gravity, to a location above which said viscous medium applicator is disposed.

9. Apparatus according to claim 8, wherein said inclined track section comprises spaced apart rails which merge with rails underlying said applicator to form a continuous track run therewith, the spacing between the rails of said inclined track being adjustable.

10. Apparatus according to claim 9, wherein means is provided above said inclined track section in cooperation with the means for inducing movement of and spacing the workpiece members for impeding movement for a predetermined time of individual ones of said members down said track whereby to feed said individual members at predetermined intervals to the track underlying the applicator thereby predeterminedly spacing said members from one another on said track prior to moving past said viscous medium applicator.

11. Apparatus according to claim 1, wherein the means for inducing movement of said workpiece members along the track comprises an endless belt driven by drive rollers, said belt extending along a horizontal section of said track.

12. Apparatus according to claim 11, wherein the drive rollers and belt are related to one another for imparting to the latter relatively low belt tension.

13. Apparatus according to claim 12, wherein said belt includes upper and lower runs, the lower run thereof being located above said track and adjustably spaced therefrom.

14. Apparatus according to claim 1, wherein the viscous medium comprises microcapsules suspended in a carrier fluid and enclosing a coating medium.

15. Apparatus according to claim 13, wherein spaced apart idler rollers are provided between said drive rollers, said idler rollers being spring urged toward said track from which said idler rollers are spaced a distance less than the cross sectional dimension of said members.

16. The apparatus according to claim 1, wherein the means for inducing movement of and longitudinally spacing said members comprises means for decreasing the speed of said members along the track.

17. Apparatus for coating a fluid viscous medium onto predetermined surface portions of a plurality of workpiece members each having an axis about which said members are symmetrical, comprising a track on which said plurality of members are supportable for movement therealong with their axes in horizontal orientation perpendicular to their direction of travel along said track, a viscous medium applicator disposed above said track, said applicator comprising a plurality of discharge tubes extending vertically downwardly toward said track each terminating in an end having an opening, means for supplying viscous medium to said applicator at a constant pressure to permit the suspension at the end of each of said tubes of a droplet of said viscous medium, comprising a reservoir from the viscous medium, an outlet line extending from the reservoir and connected to the viscous medium applicator, a valve in said outlet line, said reservoir having a hermetically sealable filling spout at an upper end portion thereof and a separate annular chamber therein at a bottom end portion thereof adapted to communicate with the atmosphere and with the interior of said reservoir through a bottom opening formed in said separate chamber, said discharge tubes being spaced from said track a distance governed by the cross sectional dimension of said workpiece members to ensure contact of said workpiece members with said suspended droplets of viscous medium as said members are moved along said track so as to wipe suspended viscous medium therefrom, and an endless belt driven by drive rollers, said belt including upper and lower runs, the lower run of which is located above said track and engageable with waid workpiece members, spaced apart idler rollers being provided between said drive rollers, said idler rollers being spring urged toward said track from which said idler rollers are spaced a distance less than the cross sectional dimension of said members, the cooperation of said belt and said spring urged idler rollers causing said workpieces to roll along said track speed from each other.

* * * * *